US006976906B2

(12) United States Patent
Boyd et al.

(10) Patent No.: US 6,976,906 B2
(45) **Date of Patent: *Dec. 20, 2005**

(54) APPARATUS FOR REDUCING COMPRESSED DRY AIR USAGE DURING CHEMICAL MECHANICAL PLANARIZATION

(75) Inventors: John M. Boyd, Atascadero, CA (US); David Wei, Fremont, CA (US); Yehiel Gotkis, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 97 days.

This patent is subject to a terminal disclaimer.

(21) Appl. No.: 10/681,719

(22) Filed: Oct. 7, 2003

(65) Prior Publication Data

US 2004/0067720 A1 Apr. 8, 2004

Related U.S. Application Data

(63) Continuation of application No. 10/029,742, filed on Dec. 21, 2001, now Pat. No. 6,656,024.

(51) Int. Cl.[7] ..... B24B 5/00
(52) U.S. Cl. ..... 451/41; 451/24; 451/285; 451/303

(58) Field of Search ..... 451/24, 41, 283, 451/296, 285–290, 303, 387, 388, 397, 398, 451/173, 168

(56) References Cited

U.S. PATENT DOCUMENTS

| | | | | |
|---|---|---|---|---|
| 5,722,877 | A * | 3/1998 | Meyer et al. | 451/41 |
| 6,336,851 | B1 * | 1/2002 | Shendon | 451/303 |
| 6,443,810 | B1 * | 9/2002 | Shih | 451/41 |
| 6,761,626 | B2 * | 7/2004 | de la Llera et al. | 451/303 |

* cited by examiner

*Primary Examiner*—Lee D. Wilson
*Assistant Examiner*—Anthony Ojini
(74) *Attorney, Agent, or Firm*—Martine Penilla & Gencarella, LLP

(57) ABSTRACT

A chemical mechanical planarization (CMP) system is provided. The system includes a polishing surface and a platen disposed along an underside of the polishing surface. A retaining ring surrounds the platen. The retaining ring includes a lower annular sleeve and an upper annular sleeve moveably disposed over the lower annular sleeve. A method for reducing a consumption of compressed dry air (CDA) during a chemical mechanical planarization (CMP) operation is also described.

9 Claims, 8 Drawing Sheets

APPARATUS FOR REDUCING COMPRESSED DRY AIR USAGE DURING CHEMICAL MECHANICAL PLANARIZATION

CROSS REFERENCE TO RELATED APPLICATION

This application is continuation of U.S. patent application Ser. No. 10/029,742, entitled "METHOD AND APPARATUS FOR COMPRESSED DRY AIR USAGE DURING CHEMICAL MECHANICAL PLANARIZATION," filed on Dec. 21, 2001 now U.S. Pat. No. 6,656,024.

BACKGROUND OF THE INVENTION

The present invention relates generally to semiconductor fabrication and, more particularly, to a method and apparatus for reducing consumption of compressed dry air (CDA) during chemical mechanical planarization (CMP) operations.

CMP systems are designed to planarize a wafer surface by applying the wafer against a polishing surface in the presence of an abrasive slurry. In some CMP systems, the polishing surface is a belt. For example, the TERES™ CMP system, which is commercially available from Lam Research Corporation, the assignee of this application, is one such belt-type CMP system. FIG. 1 is a simplified schematic diagram of a conventional belt-type CMP system. In this system, polishing surface 100 is in the form of a belt that is driven by rotors 102. Wafer carrier 104 supporting a wafer is disposed over polishing surface 100 and forces the wafer against the polishing surface during the CMP process. Air-bearing platen 106 provides friction-free support to the underside of polishing surface 100 through a layer of compressed dry air (CDA) supplied from a CDA source connected to platen 106.

During CMP operations, the air-bearing platen 106 consumes a significant amount of CDA. The amount of CDA is a function of the size of the wafers being processed. Consequently, as chip fabricators shift from 200 millimeter (mm) wafers to 300 mm wafers the annual cost of CDA significantly increases. Because of the high consumption rate of CDA by air-bearing platens, chip fabricators must also incur capital expenditures to add CDA capacity when purchasing additional CMP systems with air-bearing platens.

Another shortcoming of the belt-type CMP system of FIG. 1 is the transient losses of the CDA at the edge of platen 106. Due to inherent transient losses, the support provided for polishing surface 100 degrades at the edges of the platen. Consequently, the removal rate at the edge of the wafer is the most challenging region on the wafer to control during CMP operations. If the removal rate at the edge of the wafer differs from that for the remainder of the wafer, then the wafer is not planarized evenly. Hence, yields and device quality may be negatively impacted.

In view of the foregoing, there is a need for a method and apparatus for reducing the consumption of CDA during CMP operations and limiting transient losses around the edge of the wafer to provide more uniform support for the entire surface of the wafer.

SUMMARY OF THE INVENTION

Broadly speaking, the present invention fills this need by providing a retaining ring which reduces the consumption of compressed dry air (CDA) during chemical mechanical planarization (CMP) operations. The present invention also provides a method for reducing a consumption of CDA during a CMP operation In accordance with one aspect of the present invention, a retaining ring is provided. The retaining ring includes a lower annular sleeve having a base. An inner sidewall and an outer sidewall extend from the base. The lower annular sleeve has at least one hole defined therein. An upper annular sleeve is moveably disposed over the lower annular sleeve. The upper annular sleeve has a top that may have one or more holes defined therein. An inner sidewall and an outer sidewall extend from the top.

In accordance with another aspect of the invention, a chemical mechanical planarization (CMP) system is provided. The system includes a polishing surface and a platen disposed along an underside of the polishing surface. The platen is configured to be coupled to a first fluid source. A retaining ring surrounds the platen. The retaining ring includes a lower annular sleeve and an upper annular sleeve moveably disposed over the lower annular sleeve. The lower annular sleeve is fixed and has at least one hole configured to be coupled to a second fluid source.

In accordance with yet another aspect of the invention, a method for reducing a consumption of CDA during a CMP operation. In this method an air-bearing platen is surrounded by a retaining ring having a moveable sleeve. The moveable sleeve of the retaining ring is moved into close proximity with an underside of a polishing surface. A CMP operation is then conducted during which the retaining ring reduces the consumption of CDA and limits transient losses around the edge of a wafer undergoing the CMP operation.

It is to be understood that the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate exemplary embodiments of the invention and together with the description serve to explain the principles of the invention.

DETAILED DESCRIPTION OF THE INVENTION

Figure 1:
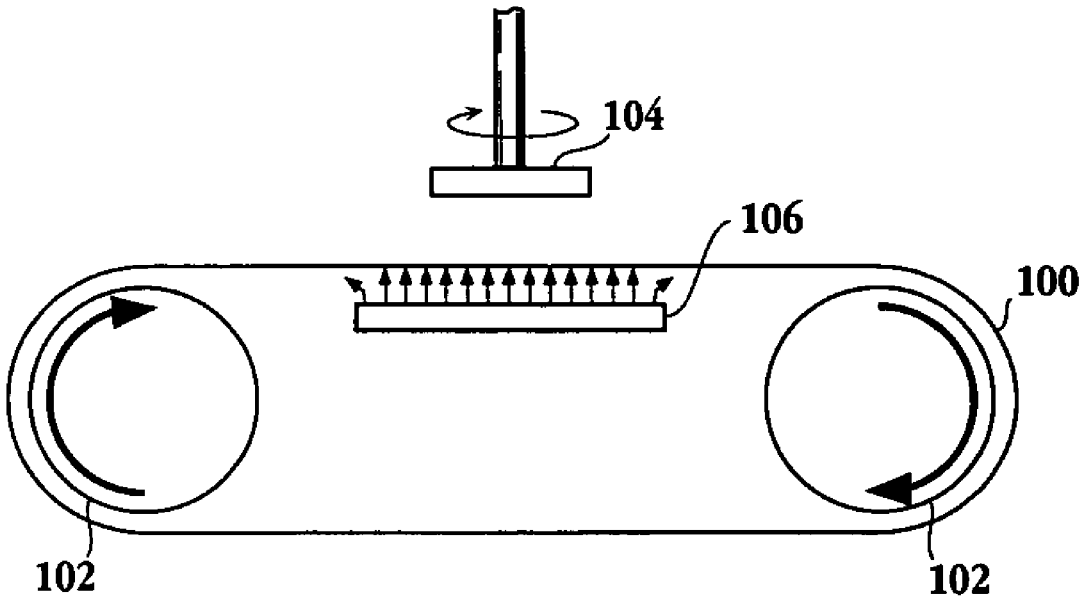
Fig. 1 (Prior Art)
FIG. 1 is a simplified schematic diagram of a conventional belt-type CMP system.

Several exemplary embodiments of the invention will now be described in detail with reference to the accompanying drawings. FIG. 1 is discussed above in the "Background of the Invention" section.

Figure 2:
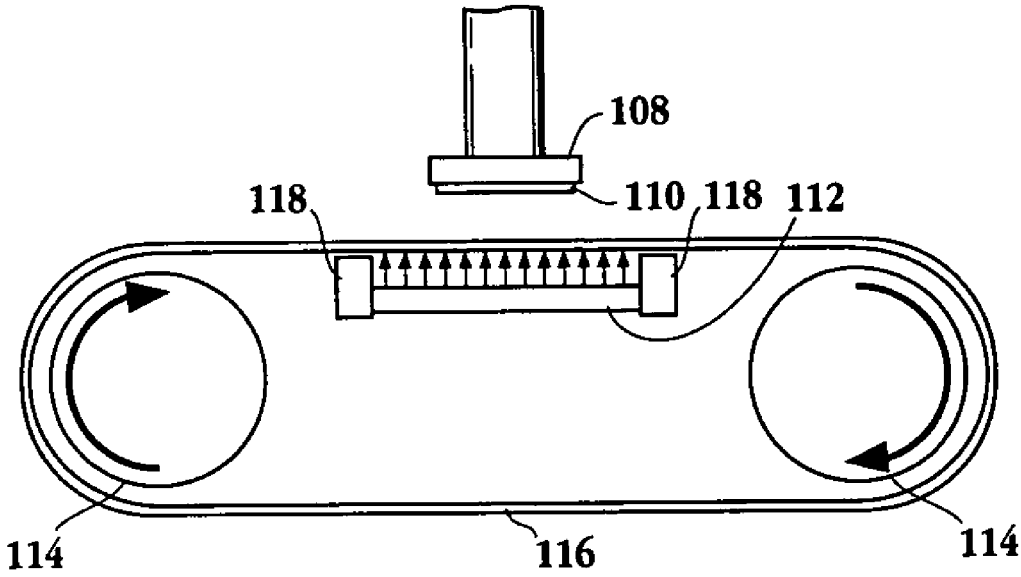
FIG. 2 is a simplified schematic diagram of a chemical mechanical planarization system (CMP) configured to reduce the consumption of compressed dry air (CDA) in accordance with one embodiment of the invention.

FIG. 2 is a simplified schematic diagram of a chemical mechanical planarization system (CMP) configured to reduce the consumption of compressed dry air (CDA) in accordance with one embodiment of the invention. A polishing surface 116 is mounted on rotors 114. Air-bearing platen 112 is disposed under polishing surface 116 and between rotors 114. As is well known to those skilled in the art, air-bearing platen 112 provides low friction support for the underside of polishing surface 116. Retaining ring 118 surrounding platen 112. Wafer carrier 108 is disposed over polishing surface 116 and supports wafer 110. During operation, rotors 114 rotate around their axis and drive polishing surface 116 in a linear direction over air-bearing platen 112. As wafer carrier 108 forces wafer 110 against the top surface of polishing surface 116, a layer of compressed dry air (CDA) from air bearing platen 112 supports polishing surface 116. Retaining ring 118 constrains the CDA layer between polishing surface 116 and platen 112. As will be explained in more detail below, retaining ring 118 is configured to minimize CDA losses without perturbing the interaction angle between polishing surface 116 and wafer 110.

Figure 3:
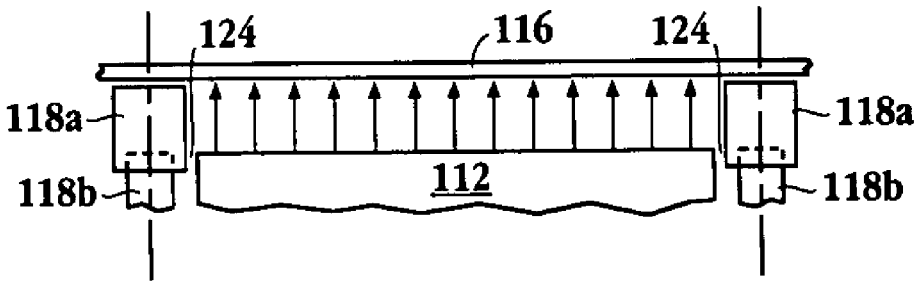
FIG. 3 is a simplified cross-sectional view of a platen and a retaining ring in accordance with one embodiment of the invention.

FIG. 3 is a simplified cross-sectional view of a platen and a retaining ring in accordance with one embodiment of the invention. As shown therein, retaining ring 118 includes upper annular sleeve 118*a* and lower annular sleeve 118*b*. Upper annular sleeve 118*a* is moveably disposed over lower annular sleeve 118*b* and is capable of automatically aligning to the underside of polishing surface 116, as will be described in more detail below with reference to FIGS. 8–11. Lower annular sleeve 118*b* is fixed, i.e., rigidly attached, to a suitable part of the CMP system. It will be apparent to one skilled in the art that lower annular sleeve 118*b* can be attached to any parts of the CMP system that are capable of providing rigid support for the lower annular sleeve. In one embodiment, lower annular sleeve 118*b* is attached to platen 112. When upper annular sleeve 118*a* is in a raised position as shown in FIG. 3, the CDA from air-bearing platen 112 is constrained in a region defined by the upper annular sleeve, platen 112 and polishing surface 116. Additionally, transient losses at edge 124 of platen 112 are reduced, which in turn provides for tighter control of the removal rate at the edge of the wafer being planarized. It should be appreciated that the retaining ring allows for the controlled release of the constrained air, e.g., through the gap between the top of the upper annular sleeve and the underside of the polishing surface, to preclude chattering of the polishing surface. However, the amount of air lost via this controlled release is significantly reduced relative to the amount of air lost in conventional CMP systems.

Figure 4:
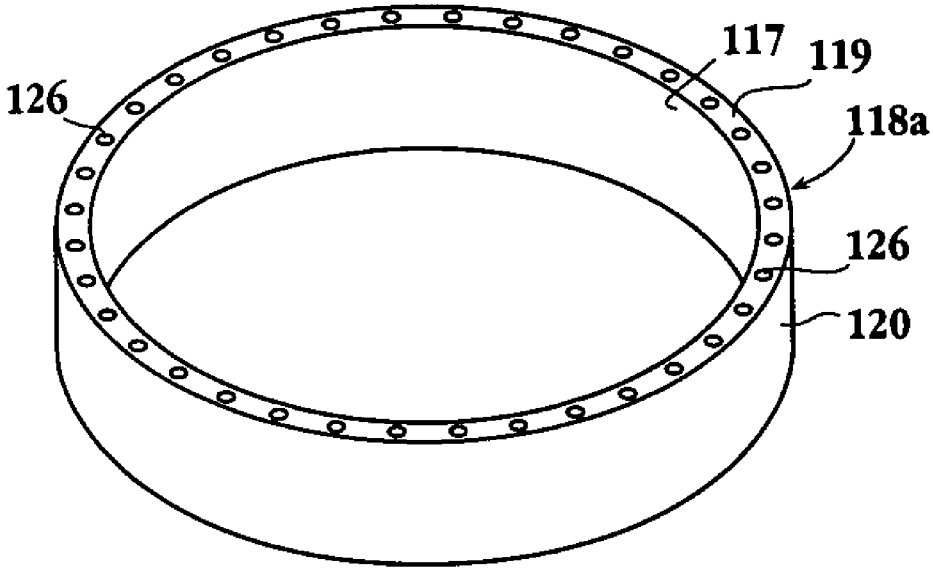
FIG. 4 is a top view of an upper annular sleeve of a retaining ring in accordance with one embodiment of the invention.

FIG. 4 is a top view of an upper annular sleeve of a retaining ring in accordance with one embodiment of the invention. Upper annular sleeve 118*a* of the retaining ring has a top surface 119 with outer sidewall 120 extending from top surface 119. An inner sidewall 117 also extends from top surface 119. A plurality of holes 126 extend through top surface 119 of upper annular sleeve 118*a*. Holes 126 allow for lubrication of the interface between the retaining ring and polishing surface as will be explained in more detail in reference to FIGS. 6 and 7. One skilled in the art will appreciate that holes 126 can be configured in any pattern that allows for upper annular sleeve 118*a* to move in close proximity to the underside of the polishing surface.

Figure 5:
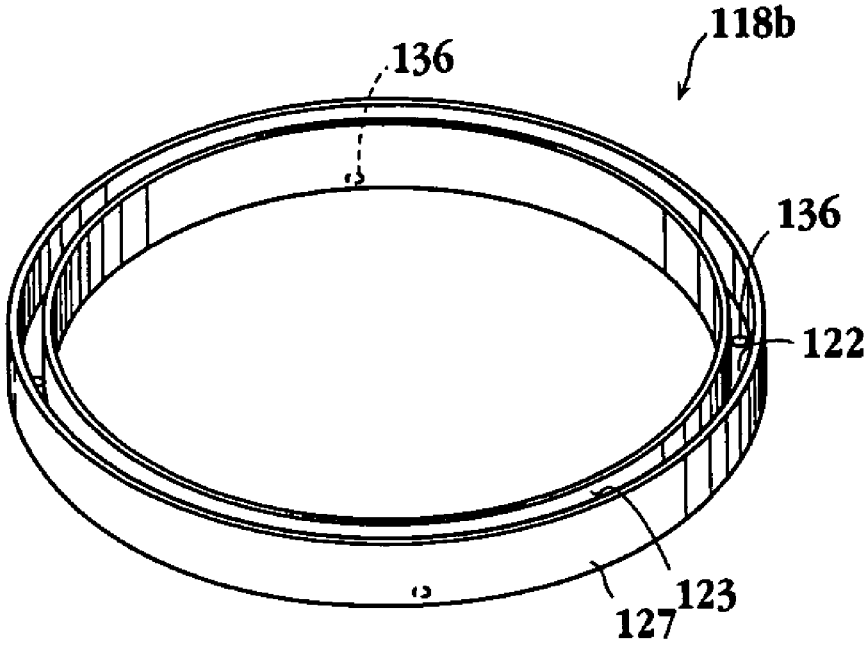
FIG. 5 is a top view a lower annular sleeve of a retaining ring in accordance with one embodiment of the invention.

FIG. 5 is a top view a lower annular sleeve of a retaining ring in accordance with one embodiment of the invention. Lower annular sleeve 118*b* includes base 122 that has inner sidewall 123 and outer sidewall 127 extending from base 122. Holes 136 extend through base 122 of lower annular sleeve 118*b*. As will be explained in more detail with respect to FIG. 10, holes 136 are configured to be connected to a fluid source. The fluid source provides a fluid flow to lower annular sleeve 118*b* which in turn causes the upper annular sleeve to move as will be described in more detail with reference to FIGS. 9 and 10. It should be appreciated that upper annular sleeve 118*a* of FIG. 4 nests with lower annular sleeve 118*b* to form the retaining ring.

Figure 6:
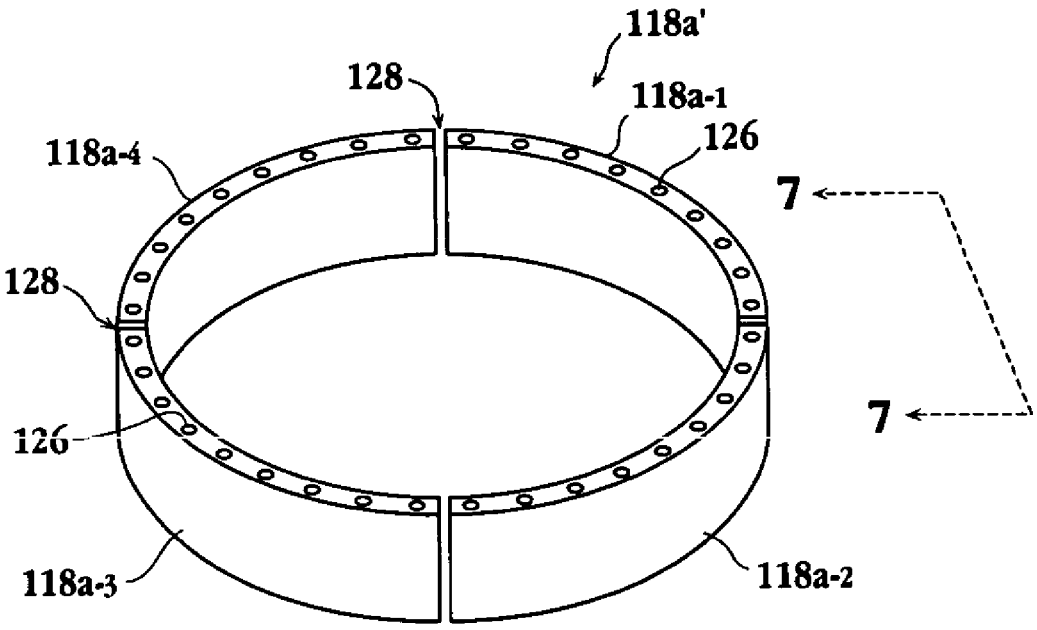
FIG. 6 is a top view of an upper annular sleeve of a retaining ring in accordance with one embodiment of the invention.
Figure 7:
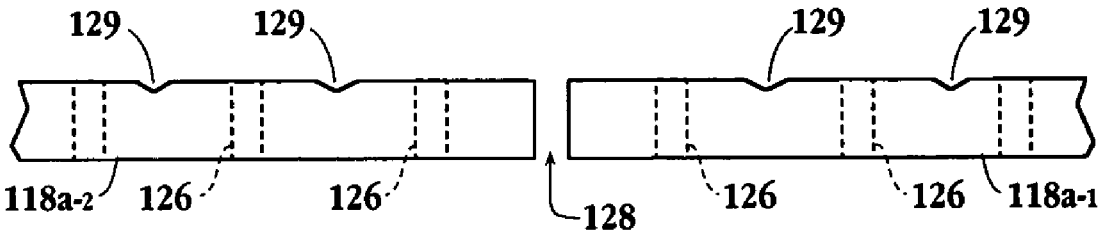
FIG. 7 is a side view that shows channels formed in the top surface of the two curved members of an annular sleeve in accordance with one embodiment of the invention.

FIG. 6 is a top view of an upper annular sleeve of a retaining ring in accordance with one embodiment of the invention. Upper annular sleeve 118*a*' the same as upper annular sleeve 118 of FIG. 4, however, upper annular sleeve 118*a*' is quartered as depicted by upper curved members 118*a*-1, 118*a*-2, 118*a*-3 and 118*a*-4. Of course, each of upper curved members 118*a*-1, 118*a*-2, 118*a*-3 and 118*a*-4 is moveably disposed over corresponding lower curved members. That is, lower annular sleeve 118*b* of FIG. 5 would be similarly quartered into lower curved members and nested with upper annular sleeve 118'. Gaps 128 between each of the upper curved members 118*a*-1, 118*a*-2, 118*a*-3 and 118*a*-4 provide controlled release points to avoid chattering of the polishing surface. Alternatively, upper annular sleeve 118*a* may include relief channels to systematically release the CDA from air-bearing platen 112 as shown in FIG. 7. The systematic release of the CDA avoids the build-up of pressure between platen 112 and the polishing surface when the upper annular sleeve is in close proximity to the underside of the polishing surface. It will be apparent to one skilled in the art that the configuration of annular ring 118*a*' allows for the individual control of each curved member. Thus, variations or localized deflections of the polishing surface are more easily accommodated. FIG. 6 illustrates retaining ring 118*a*' as four (4) curved members for exemplary purposes only and is not meant to be limiting, as retaining ring 118*a*' can be configured in any number of curved members.

FIG. 7 is a side view that shows channels formed in the top surface of the two curved members of an annular sleeve in accordance with one embodiment of the invention. Relief channels 129 allow for the controlled release of compressed dry air to preclude chattering of the polishing surface. One skilled in the art will appreciate that relief channels 129 can be implemented in numerous ways such as providing a v-shaped channel across the top surface of curved members 118*a*-1 and 118*a*-2 of the upper annular sleeve between holes 126. As shown in FIG. 7, relief notches 129 provide a mechanism for the systematic release of CDA in addition to gap 128. While relief channels 129 are depicted as a V-shaped channel across the top surface of the upper annular sleeve, it will be apparent to one skilled in the art that a number of other geometric configurations also can be used, e.g., rectangular-shaped channels or U-shaped channels.

Figure 8:
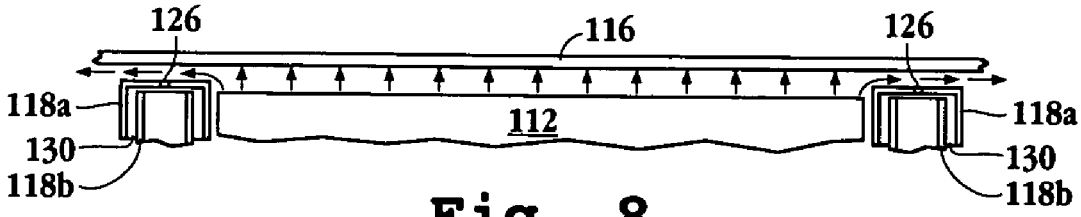
FIG. 8 is a cross-sectional view of a retaining ring with an upper annular sleeve in a relaxed state in accordance with one embodiment of the invention.

FIG. 8 is a cross-sectional view of a retaining ring with an upper annular sleeve in a relaxed state in accordance with one embodiment of the invention. As shown here, it can be seen that upper annular sleeve 118*a* is a sleeve disposed over lower annular sleeve 118*b*. As shown in FIG. 8, the inner and outer sidewalls of lower annular sleeve 118*b* are contained between the inner and outer sidewalls of upper annular sleeve 118*a*. Thus, a gap 130 exists between the inner and outer sidewalls of upper annular sleeve 118*a* and the corresponding inner and outer sidewalls of lower annular sleeve 118*b* in one embodiment. As discussed in more detail with respect to FIG. 9, gap 130 can act as a release for excess fluid to flow out of the region between lower annular sleeve 118*b* and upper annular sleeve 118*a*. In a relaxed state, i.e., where no fluid flow is being supplied through lower annular sleeve 118*b*, upper annular sleeve 118*a* is not in close proximity to the underside of polishing surface 116. Thus, CDA supplied from air-bearing platen 112 is not constrained in a region defined between platen 112 retaining ring 118 and polishing surface 116.

Figure 9:
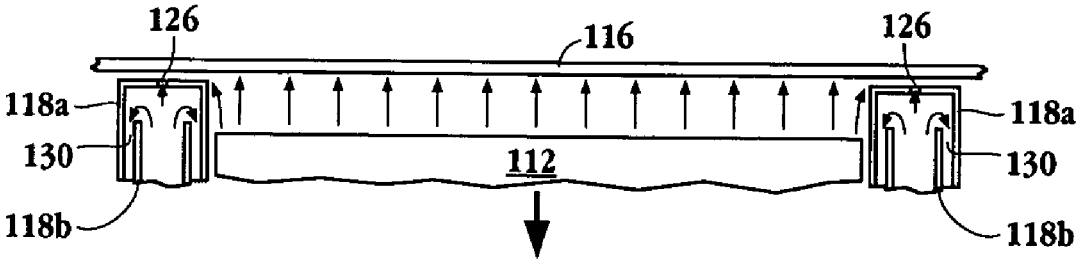
FIG. 9 is a cross-sectional view of the retaining ring shown in FIG. 8 with the upper annular sleeve in a raised state.

FIG. 9 is a cross-sectional view of the retaining ring shown in FIG. 8 with the upper annular sleeve in a raised state. A flow of fluid is supplied through lower annular sleeve 118*b*. The pressure created by the fluid flow forces upper annular sleeve 118*a* to rise. One skilled in the art will appreciate that the fluid flow rate, the area of hole 126, and the size of gap 130 between the lower annular sleeve 118*b* and the upper annular sleeve 118*a* impact the distance traveled by upper annular sleeve 118*a*. As mentioned above, these parameters are configured so that upper annular sleeve 118*a* can move into close proximity with the underside of polishing surface 116 without perturbing polishing surface 116. Accordingly, a wafer interaction angle is controlled by the distance of platen 112 from polishing surface 116 and not by the movement of retaining ring 118. It should be further appreciated that the configuration illustrated in FIG. 9 allows for a gimbal effect between upper annular sleeve 118*a* and lower annular sleeve 118*b*, so that the upper annular sleeve can self-align to the underside of polishing surface 116.

The interaction angle between polishing surface 116 and a wafer being planarized impacts the removal rate at the edge of the wafer particularly in a region within 10 millimeters of the wafer edge. This angle is controlled in part by regulating the distance between platen 112 and polishing surface 116. By providing a floating retaining ring 118, i.e., a retaining ring 118 with a moveable upper annular sleeve 118*a*, the interaction angle remains controllable by the distance between platen 112 and polishing surface 116. Additionally, when upper annular sleeve 118*a* of retaining ring 118 is raised, transient losses of CDA at the edge of platen 112 are reduced. Therefore, the steady-state performance of the layer of CDA for supporting polishing surface 116 is improved at the edge of platen 112. In turn, the removal rate at the edge of a wafer subjected to the CMP process is able to be more tightly controlled because of the increased support for the polishing surface at the edge of platen 112.

Still referring to FIG. 9, the fluid is supplied to lower annular sleeve 118*b* which manifolds the DIW to upper annular sleeve 118*a*. Upper annular sleeve 118*a* travels along a vertical axis of the retaining ring in response to the fluid flow to lower annular sleeve 118*b*. In one embodiment, the fluid provided to activate upper annular sleeve 118*a* is de-ionized water (DIW). A portion of the fluid supplied to lower annular sleeve 118*b* flows through hole 126 to lubricate the interface between upper annular sleeve 118*a* and polishing surface 116. As mentioned previously, gap 130, between lower annular sleeve 118*b* and upper annular sleeve 118*a*, allows excess fluid to escape. The fluid portions that flow through gap 130 or holes 126 can be collected and recycled in one embodiment of the present invention. A travel limiter, as discussed with respect to FIGS. 10 and 11, can limit the distance upper annular sleeve 118*a* traverses from a relaxed position to a fully raised position.

Figure 10:
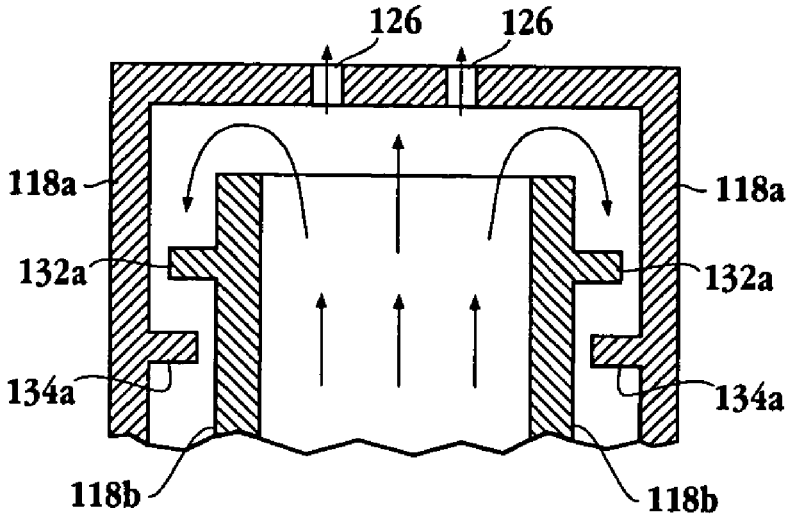
FIG. 10 is a partial cross-sectional view of a retaining ring.

FIG. 10 is a partial cross-sectional view of a retaining ring. Upper annular sleeve 118*a* is raised by a pressure created by a flow of fluid through lower annular sleeve 118*b*. One skilled in the art will appreciate that upper annular sleeve 118*a* can be made from any suitable material compatible with the fluid and the CMP process. Exemplary materials include general purpose plastic materials. In one embodiment, upper annular sleeve 118*a* is comprised of a friction resistant polymeric material such as DELRIN™ acetal resins. Holes 126 allow the fluid to lubricate the interface between the polishing surface and the top surface of upper annular sleeve 118*a* during CMP operations. While FIG. 10 displays two holes 126 along the cross-sectional view of the top of upper annular sleeve 118*a*, those skilled in the art will recognize that any number or pattern of holes 126 can be used which allow the interface to be lubricated without perturbing the polishing surface. Of course, the pattern of holes are configured to allow a pressure from the fluid flow through lower annular sleeve 118*b* to lift upper annular sleeve 118*a* into close proximity to the underside of the polishing surface.

Still referring to FIG. 10, protrusions 132*a* and 132*b* of lower annular sleeve 118*b* and corresponding protrusions 134*a* and 134*b* of upper annular sleeve 118*a* act as travel limiters. In particular, as the fluid forces the upper annular sleeve 118*a* to rise, protrusion 134*a* and protrusion 134*b* will limit the travel of upper annular sleeve 118*a* as they meet protrusion 132*a* and protrusion 134*b*, respectively. It will be apparent to one skilled in the art, that any configuration can be applied in place of the protrusions 132*a* and 132*b* and 134*a* and 134*b*, as long as upper annular sleeve 118*a* is limited in the distance that the upper annular sleeve can travel above lower annular sleeve 118*b*.

Figure 11:
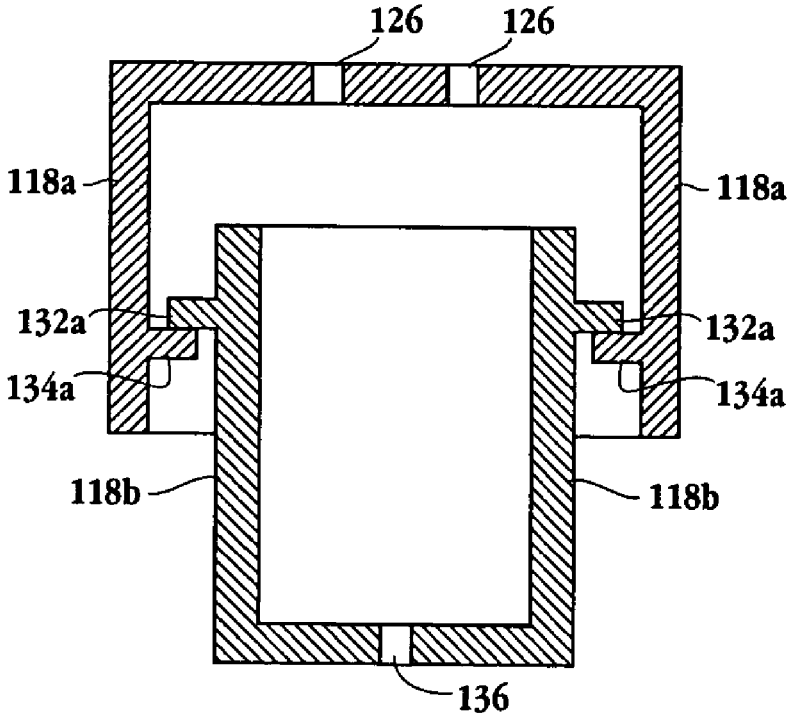
FIG. 11 is a cross-sectional view of the upper annular sleeve and the lower annular sleeve of the retaining ring.

FIG. 11 is a cross-sectional view of the upper annular sleeve and the lower annular sleeve of the retaining ring. As shown here, lower annular sleeve 118*b* includes hole 136. Hole 136 enables fluid from a fluid source to be supplied to lower annular sleeve 118*b*. Lower annular sleeve 118*b* manifolds the fluid to upper annular sleeve 118*a* which results in upper annular sleeve 118*a* moving to a close proximity to the underside of the polishing surface. Of course, protrusions 132*a*, 134*b*, 134*a* and 134*b* limit the movement of upper annular sleeve 118*a* to preclude the upper annular sleeve from being forced off of lower annular sleeve 118*b*. In one embodiment, the pressure created by the fluid flow is sufficient to raise upper annular sleeve 118*a* into close proximity with the underside of the polishing surface and provide lubrication to an interface between the polishing surface and upper annular sleeve 118*a*. While one hole is shown in FIG. 11, it will be apparent to one skilled in the art that any number of holes 136 can be defined in the base of lower annular sleeve 118*b*

Figure 12:
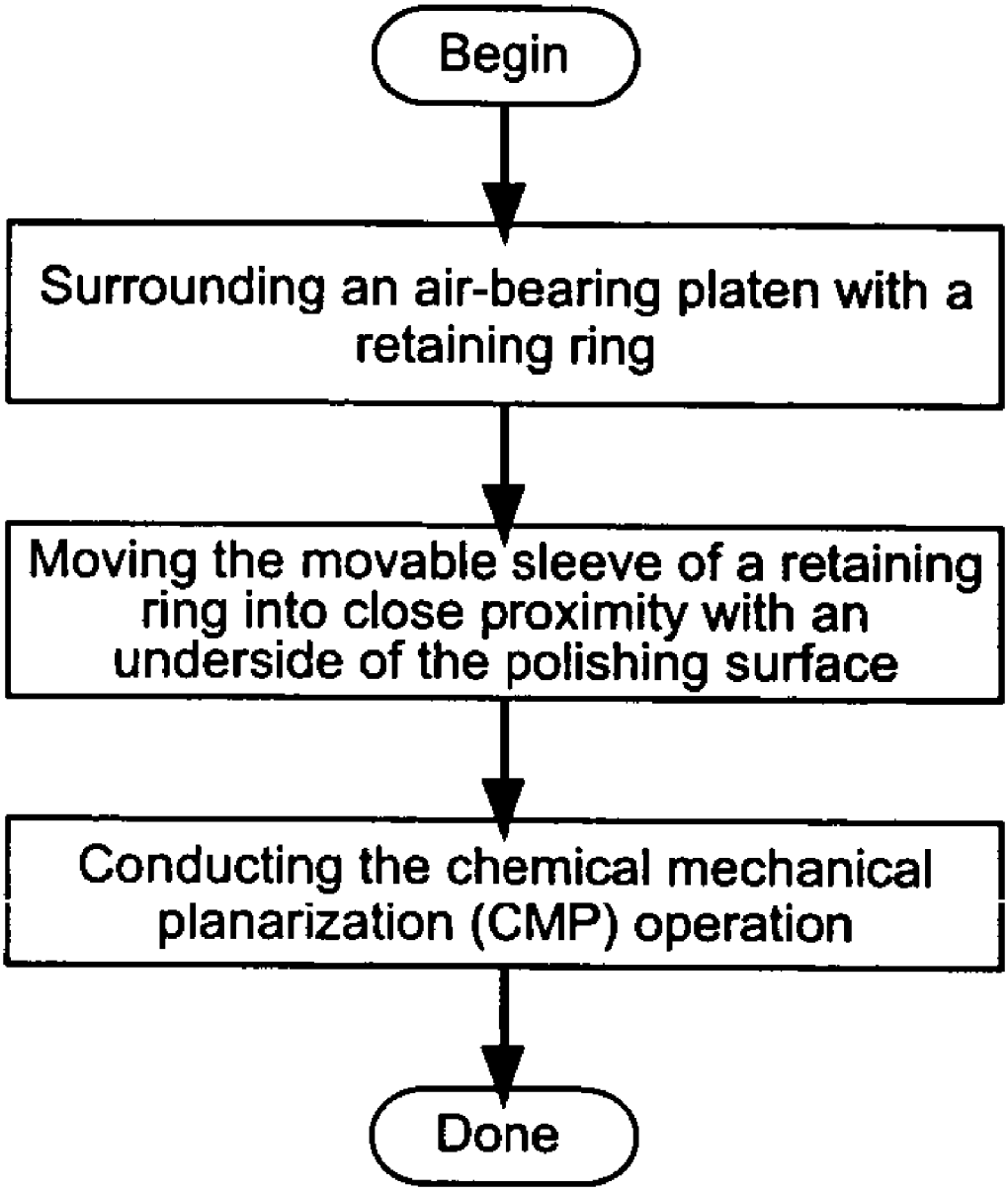
FIG. 12 is a flowchart diagram of the method operations performed in reducing consumption of compressed dry air (CDA) during a chemical mechanical planarization (CMP) operation in accordance with one embodiment of the invention.

FIG. 12 is a flowchart diagram of the method operations performed in reducing consumption of compressed dry air (CDA) during a chemical mechanical planarization (CMP) operation in accordance with one embodiment of the invention. The method begins in operation 138 where an air-bearing platen is surrounded by a retaining ring. An example of a suitable retaining ring is the retaining ring described with reference to FIGS. 4–11; however, other suitable retaining rings also may be used. The method then advances to operation 140 where the moveable sleeve, e.g., the upper sleeve of the retaining ring, moves into close proximity with the underside of a polishing surface. As discussed above with reference to FIGS. 9 and 10, a fluid flow supplied to the lower sleeve of the retaining ring creates a pressure which forces the moveable sleeve of the retaining ring into close proximity with the underside of a polishing surface. In one embodiment, travel limiters governing the maximum distance the moveable sleeve can travel are provided. By adjusting the moveable sleeve into close proximity with the underside of the polishing surface, the compressed dry air supplied to the air-bearing platen for supporting the underside of the polishing surface is constrained within a region defined between the retaining ring, the platen and the polishing surface. Thus, the moveable sleeve acts as a barrier to the transient losses at the edge of the platen.

When the moveable sleeve acts as a barrier to the transient losses, one skilled in the art will appreciate that the controlled release of the constrained air precludes chattering of the polishing surface. As mentioned above, the release of the air can be regulated by channels included in the top surface of the moveable sleeve of the retaining ring. Alternatively, the pressure created by the fluid flow to the lower sleeve of the retaining ring can regulate the distance the moveable sleeve travels in order to moderate the loss of compressed dry air. While there is a controlled release of the constrained air, it should be appreciated that the losses are significantly reduced as compared to when there is no retaining ring surrounding the platen. The method then moves to operation 142 where the CMP operation is conducted. As the moveable sleeve is raised, the compressed dry air is constrained and transient losses near the edge of the platen are reduced. Therefore, during the CMP operation tighter control over the removal rate near the edge of the wafer being subjected to the CMP operation is provided.

In summary, the present invention provides a retaining ring that constrains the compressed dry air within a region between the retaining ring, the platen and the polishing surface and a method for reducing consumption of compressed dry air during CMP operations. The invention has been described herein in terms of several exemplary embodiments. Other embodiments of the invention will be apparent to those skilled in the art from consideration of the specification and practice of the invention. The embodiments and preferred features described above should be considered exemplary, with the invention being defined by the appended claims.

What is claimed is:

1. A chemical mechanical planarization (CMP) system, the system comprising:

a polishing surface;

a platen disposed along an underside of the polishing surface; and a retaining ring surrounding the platen, the retaining ring including a fixed lower annular sleeve.

2. The CMP system of claim 1, wherein the retaining ring includes an upper annular sleeve moveably disposed over the lower annular sleeve.

3. The CMP system of claim 2, wherein the lower annular sleeve includes at least two lower curved members and the upper annular sleeve includes at least two upper curved members, each of the at least two upper curved members being moveably disposed over a corresponding lower curved member.

4. The CMP system of claim 2, wherein the lower annular sleeve includes a base having an inner sidewall and an outer sidewall extending therefrom and the upper annular sleeve includes a top having an inner sidewall and an outer sidewall extending therefrom.

5. The CMP system of claim 4, wherein an interior surface of each of the inner and outer sidewalls of the upper annular sleeve includes a protrusion, and an exterior surface of each of the inner and outer sidewalls of the lower annular sleeve includes a protrusion.

6. The CMP system of claim 5, wherein the protrusions of the upper and lower annular sleeves are positioned such that when the protrusion of the upper annular sleeve abuts against the protrusion of the lower annular sleeve, the top of the upper annular sleeve aligns to the underside of the polishing surface without disturbing an interaction angle between a wafer and the polishing surface.

7. The CMP system of claim 1, wherein the polishing surface is a belt.

8. The CMP system of claim 1, wherein a top surface of an upper annular sleeve has a channel formed therein.

9. The CMP system of claim 1, wherein a top surface of an upper annular sleeve of the retaining ring has at least one hole defined therein.

* * * * *